United States Patent [19]

Koide et al.

[11] 4,075,791

[45] Feb. 28, 1978

[54] AUTOMATIC COPYING BELT GRINDING MACHINE

[75] Inventors: Sakae Koide, Tokyo; Shigeo Aoki, Habikino; Tetsutaro Uematsu, Fuchu, all of Japan

[73] Assignees: Tahara Shoyei Kiko K.K., Tokyo; Hoshiden Electronics, Co., Ltd., Osaka, both of Japan

[21] Appl. No.: 631,659

[22] Filed: Nov. 13, 1975

[30] Foreign Application Priority Data

Nov. 14, 1974 Japan ..... 49-131779

[51] Int. Cl.[2] ..... B24B 21/02; B24B 17/00

[52] U.S. Cl. ..... 51/142; 51/101 R; 51/145 R

[58] Field of Search ..... 51/142, 144, 145 R, 51/147, 101 R, 101 LG; 90/13.4

[56] References Cited

U.S. PATENT DOCUMENTS

| | | | |
|---|---|---|---|
| 2,005,508 | 6/1935 | Shaw | 90/13.4 |
| 2,178,441 | 10/1939 | Swanson | 90/13.4 |
| 2,754,637 | 7/1956 | Schiauone | 51/144 |
| 3,041,789 | 7/1962 | Cretin-Maitenaz | 51/101 R |
| 3,589,075 | 6/1971 | Carlson | 51/101 R |
| 3,609,322 | 4/1969 | Burnett | 90/13.4 |
| 3,786,600 | 1/1974 | Bloxsom | 51/101 LG |
| 3,834,084 | 9/1974 | Sakane | 51/101 R |

*Primary Examiner*—Al Lawrence Smith
*Assistant Examiner*—Nicholas P. Godici
*Attorney, Agent, or Firm*—Fleit & Jacobson

[57] ABSTRACT

An automatic copying belt grinding machine comprising a vertically moving Z-axis slide, a horizontally moving X-axis slide, a horizontally moving X-axis slide slidably mounted on said Z-axis slide, a duplex electronic copying sensor and a grinding head swivelling device mounted together on said X-axis slide, and a pair of synchronously rotating fixture tables for respectively vertically mounting a copying model to be brought into interaction with said duplex electronic copying sensor and a workpiece to be brought into interaction with said grinding head swivelling device, whereby all these components are made to perform a copy grind machining operation jointly under the control of a simultaneous control unit.

1 Claim, 23 Drawing Figures

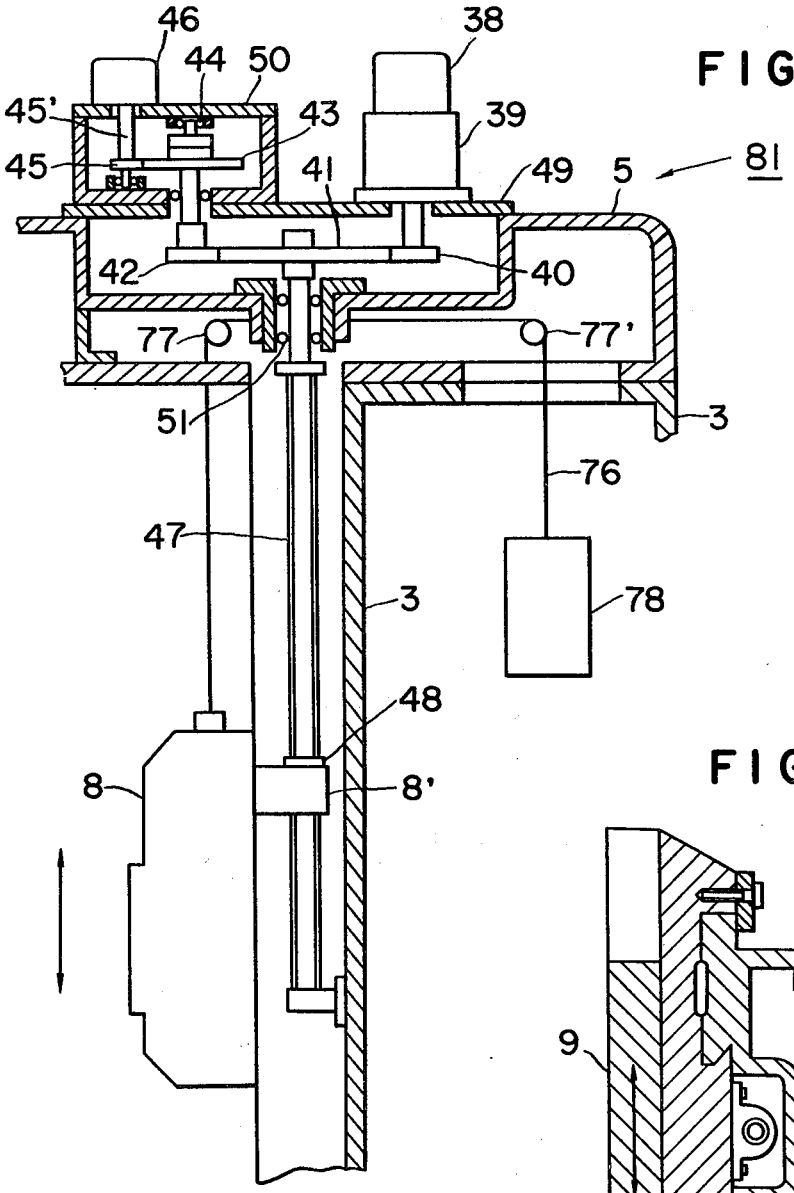
FIG. 4
FIG. 3
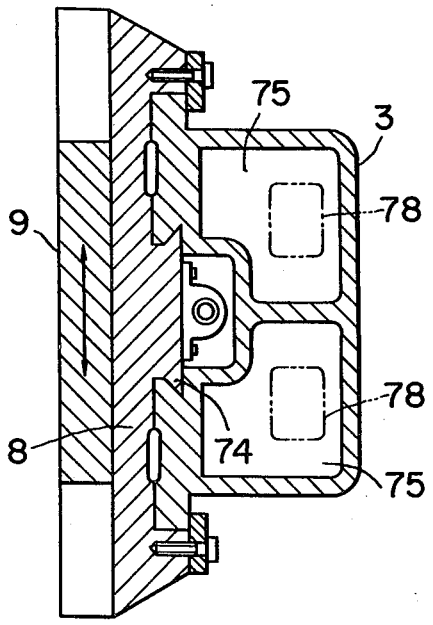

AUTOMATIC COPYING BELT GRINDING MACHINE

BACKGROUND OF THE INVENTION

The present invention relates to a belt grinding machine for automatically copy grinding the curved surfaces of such workpieces as propellers and turbine blades.

There have been many types of belt grinding machines intended for grinding turbine blades and similar workpieces proposed and used, but all of them have one or the other shortcomings such as bulky sizes and complicated mechanisms resulting in high cost, or low accuracy and efficiency resulting from variations in the angular velocity of the workpieces.

Accordingly, an object of the present invention is to provide a belt grinding machine for full-automatically copy grinding curved surfaces at high accuracy with a simple 4-axis copying control, thereby eliminating all the shortcomings mentioned above.

Below, the present invention will be described as applied in an embodiment designed to automatically copy grind the curved surfaces of turbine blades, with drawings for reference.

BRIEF DESCRIPTION OF DRAWINGS

FIG. 3 is a sectional view taken along the line A—A in FIG. 1;

FIG. 4 is a vertical sectional view of the column supporting the Z-axis slide and of the drive mechanism section above the column;

DESCRIPTION OF THE PREFERRED EMBODIMENT OF THE INVENTION

Figure 1:
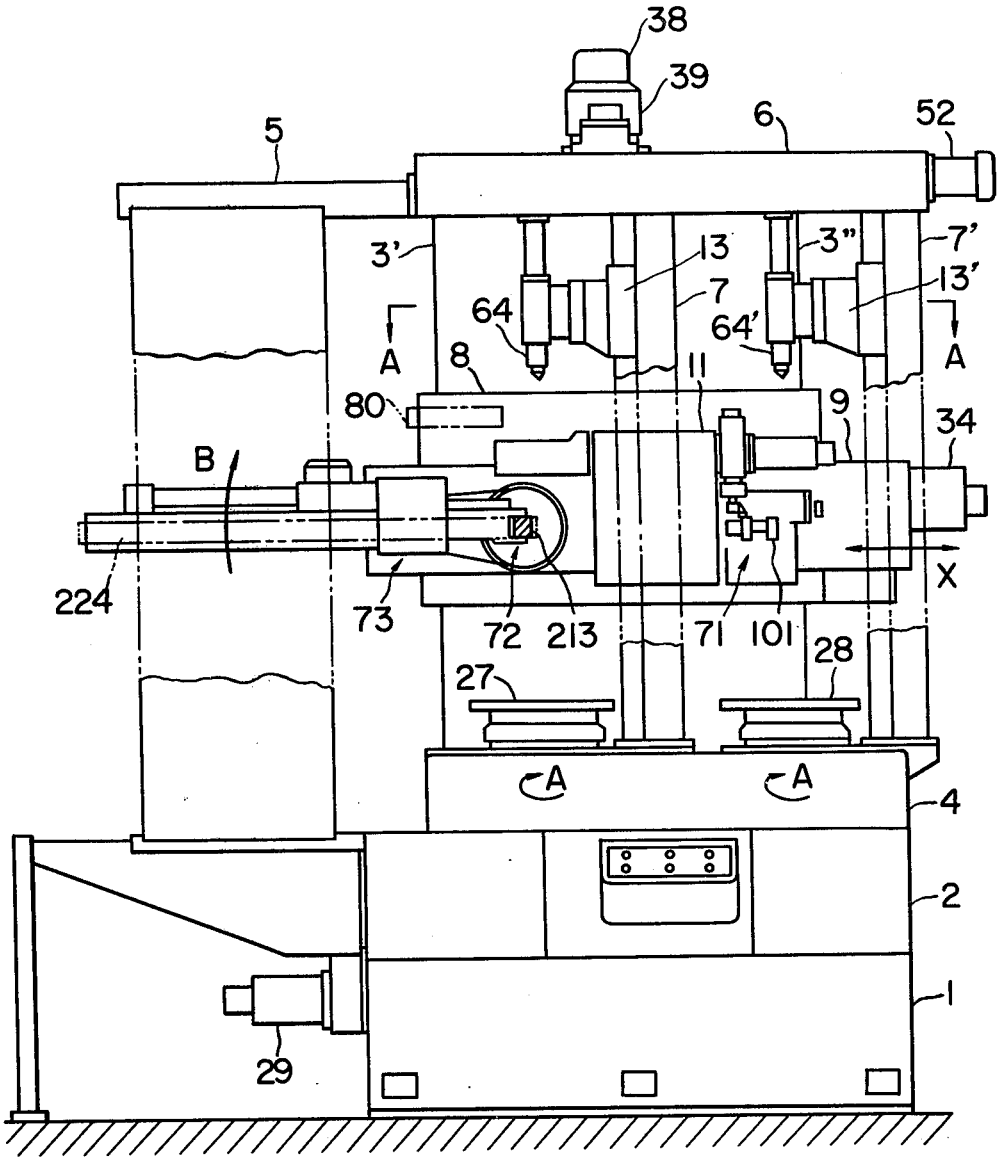
FIG. 1 is a front view of a grinding machine built as an embodiment of the present invention.
Figure 2:
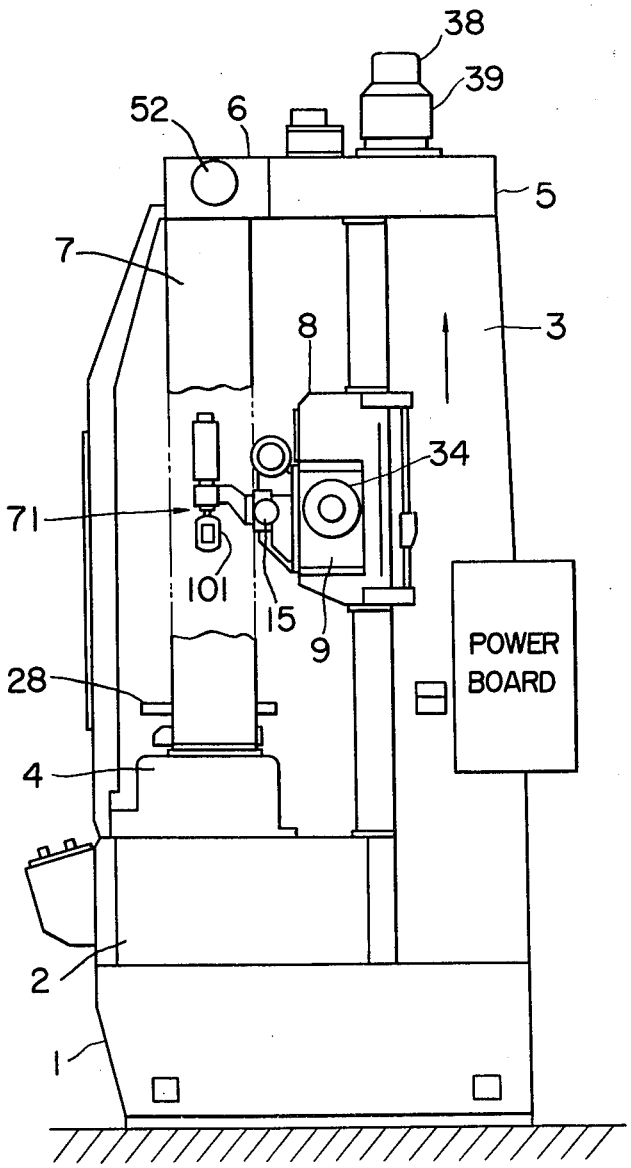
FIG. 2 is a side view of the same machine.

The general construction of a preferred embodiment machine of the present invention for grinding turbine blade surfaces can be seen in FIG. 1, a front view, and FIG. 2, a side view. The spindle stock 4 mounted on the base 2 incorporates a pair of fixture tables 27 and 28, which are disposed in parallel with an appropriate distance between them, and which are driven to rotate in exact synchronization between them. The copying model M is mounted between the fixture table 28 and the tailstock center spindle 64' located thereabove, while workpiece W is mounted between the fixture table 27 and the tailstock center spindle 64 located thereabove. On the other hand, the column 3 standing upright on the base 1 carries on its front surface the Z-axis slide 8 that is slidingly driven on the surface of the column 3 in the vertical (Z-axis) direction. The Z-axis slide 8 carries the X-axis slide 9 that is driven in the horizontal (X-axis) direction. This X-axis slide 9 carries the duplex electronic copying sensor 71 for detecting the displacement of the tracer produced by the stylus 101 being in contact with the copying model M, as well as the grinding head 72 (the portion on which the grinding belt and its drive mechanism are mounted) that is swivelled in phase with the tracing motion of the stylus 101 of said duplex electronic copying sensor 71 for copying grinding the workpiece W. Furthermore, the machine incorporates the control unit 70 for simultaneously controlling X-axis direction motion and swivelling motion of the grinding head 72 and the rotary table, and the driving section 11 for the grinding head 72.

The general working principle of the machine can also be easily understood from the two drawings, FIGS. 1 and 2 as follows: While the copying model M and the workpiece W, respectively mounted vertically on the fixture tables 28 and 27 are driven in synchronization, the stylus 101 of the duplex electronic copying sensor 71 and the grinding head 72 approach the copying model M and the workpiece W respectively sidewise in a corresponding manner until they both make a line contact respectively with the copying model M and the workpiece W, then said stylus 101 and said grinding head 72 are horizontally moved together on the X-axis slide 9 in accordance with the contour of the revolving copying model M; at the same time, they both are slowly fed upward together with the X-axis slide 9 on the Z-axis slide 8 from the lowest position of said slide 9; and finally, as the stylus 101 is angularly displaced to trace the inclined surface of the copying model M, the grinding head 72 is also angularly displaced as shown by the arrow B in FIG. 1. All these movements result in ideal copy grinding of the grinding head 72 over the surface of the workpiece W.

Now the construction of this machine is described in more detail with FIGS. 1 and 2 and others being cited as reference. On the lower base 1, in the forward part, the upper base 2 is rigidly mounted, and on this upper base 2, there is mounted a spindle stock 4 which incorporates the fixture table 28 for mounting a copying model M, and another fixture table 27 for mounting a workpiece W, said two fixture tables being disposed in parallel with an appropriate distance therebetween. On the rear part of the lower base 1, there is mounted an upright column 3 having a wide width extending from one side 3' to the other side 3''. The front surface of said column 3 forms a vertical guide way 74, while inside of this column 3 immediately behind said guide way 74 forms a hollow space 75. (see FIG. 3) Being guided along said guide way 74, there is the vertically sliding Z-axis slide 8, and on the front face of this Z-axis slide 8, there is slidably mounted the X-axis slide 9. As this X-axis slide 9 carries the duplex electronic copying sensor 71 and the other devices, when the Z-axis slide 8 is moved up and down, the X-axis slide 9 and the tracer displacement detecting device are also moved up and down together with it. On the top of the column 3, there is fixedly mounted the top pieces 5 and 6.

As shown in FIG. 4, the top piece 5 incorporates the drive mechanism 81, and the ball screw 47 driven by this drive mechanism drives the Z-axis slide 8 up and down. Described in more detail, the Z-axis slide 8 has a bracket 8' incorporating a nut 48, through which said ball screw 47 is engaged: The upper part of this ball screw 47 is supported in the bearing 51 which is fixed to the top piece 5, while at the upper end of this ball screw 47, the gear 41 is keyed: On the top plate 49 fixed on the top piece 5, there are mounted the motors 38 and 39, and the casing 50 incorporating the tachometer generator (TG) 46, thereby the motors 38 and 39, and the TG 46 are connected to the ball screw 47 through the gears 40, 41, and 42: These motors 38 and 39 are respectively a DC motor and an AC motor which are selectively coupled alternately to the output shaft by means of a clutch: When the DC motor 38 drives the ball screw 47, the gear 41 drives the gear 42, which in turn drives, over the clutch 44, the gear 43: As the gear 43 is always in engagement with the gear 45, which is fixed to the shaft 45' of the TG 46, the latter is driven together with the ball screw 47, thereby generating a revolution speed signal corresponding to the speed of the motor 38: This revolution speed signal is fed back to the control unit 70 to appropriately control the working feed motion of the Z-axis slide 8: On the other hand, when the AC motor 39 is energized, the motor 38 is declutched and also the clutch 44 is declutched, so that the Z-axis slide 8 is driven in rapid feed, but there is no control signal generated from the TG 46.

Furthermore, said Z-axis slide 8 is connected to one end of the chain 76, the other end of which is fastened to a counter-weight 78 and the middle portion of which is guided by two pulleys 77 and 77' disposed inside the top piece 5, so that said Z-axis slide 8 can be moved vertically with comparatively small force.

Figure 5:
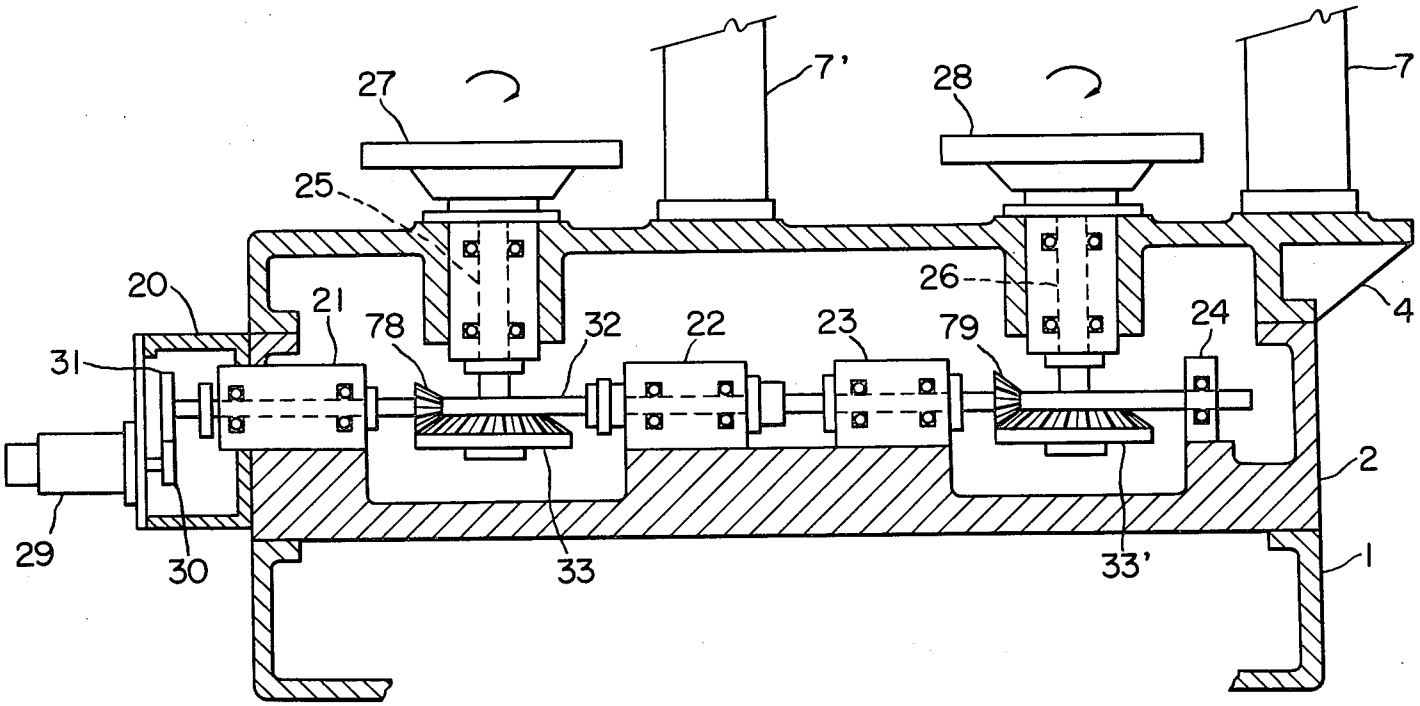
FIG. 5 is a sectional view of the fixture tables and their driving section.

Referring now to FIGS. 1 and 5, the fixture table 27 for mounting the workpiece W and the fixture table 28 for mounting the copying model M have respectively the spindles 25 and 26, which are rotatably supported in the spindle stock by means of bearings, and at the lower ends of these spindles 25 and 26, there are fixedly mounted the bevel gears 33 and 33' respectively. The motor 29 mounted on the gearbox 20 built on the side of the base 2 is driven by control signals supplied by a control unit (to be described later), and the driving motion of said motor 29 is transmitted to the drive shaft 32 through the gears 30 and 31. This drive shaft 32 is rotatably supported lengthwise inside the base 2 by means of the bearings 21, 22, 23 and 24. As the bevel gears 78 and 79 fixedly mounted on said drive shaft 32 are respectively in mesh with the bevel gears 33 and 33', when the motor 29 drives the drive shaft 32, the spindles 25 and 26 are driven in synchronization together with the respective fixture tables 27 and 28.

Figure 6:
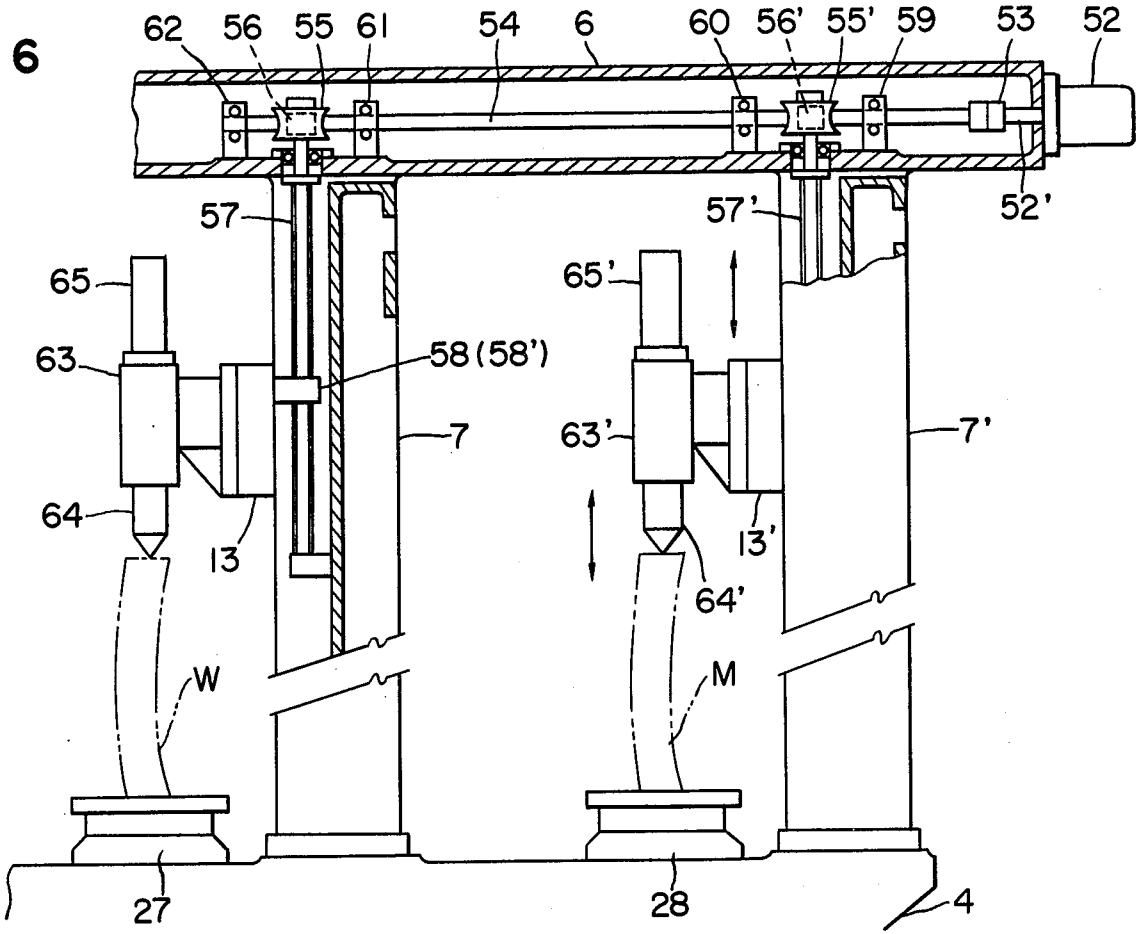
FIG. 6 is an explanatory side view of the center columns and the suitable tailstock drive mechanisms with some members partly broken away to show the interior.

Referring now to FIG. 6, the tailstock center spindles 64 and 64' for supporting the upper ends respectively of the vertical workpiece W and the copying model M mounted on the fixture tables 27 and 28 are shown together with their drive mechanisms. On the spindle stock 4, respectively beside the fixture tables 27 and 28, there are fixedly mounted two upright center columns 7 and 7', on the top ends of which, there is fastened a common top piece 6. Inside these center columns 7 and 7', respectively, there are long feed screws 57 and 57', while on the front faces of these center columns 7 and 7', there are slidably mounted tailstocks 13 and 13' respectively, with their arms extending into the inside hollows of the center columns 7 and 7' incorporating nuts 58 and 58' respectively, and said feed screws 57 and 57' are engagedly pass through said nuts, so that when said screws rotate either in one or the other direction, the tailstocks 13 and 13' are driven up or down. The tailstocks 13 and 13' have respectively the center spindle guides 63 and 63' in which the center spindles 64 and 64' are inserted, the latters being equipped with the air cylinders 65 and 65'. As the tips of these center spindles 64 and 64' are located exactly on the vertical lines passing the centers of the fixture tables 27 and 28, when the tailstocks 13 and 13' are lowered to bring the tips of the center spindles 64 and 64' in the proximity of the workiece W and the copying model M respectively, and then the center spindles 64 and 64' are forced onto the workpiece W and the copying model M respectively by means of the air cylinders 65 and 65', and the workpiece W and the copying model M are firmly and accurately centered.

The feed screws 57 and 57' are driven by the drive mechanism housed in the top piece 6 as follows: The drive motor 52 drives the transmission shaft 54 through a coupling 53, said transmission shaft 54 rotatably supported in the bearings 59, 60, 61, and 62 has worms 56 and 56' keyed thereon, and these worms 56 and 56' are in mesh with the worm gears 55 and 55' fixedly mounted respectively at the top ends of the feed screws 57 and 57'. Therefore, when the drive motor 52 runs, the two tailstocks 13 and 13' move in synchronization, and with the aid of the air cylinders 65 and 65', the center spindles 64 and 64' are capable of holding the ends of the workpiece W and the copying model M mounted respectively on the fixture tables 27 and 28 firmly but without unduly distorting them.

Figure 7:
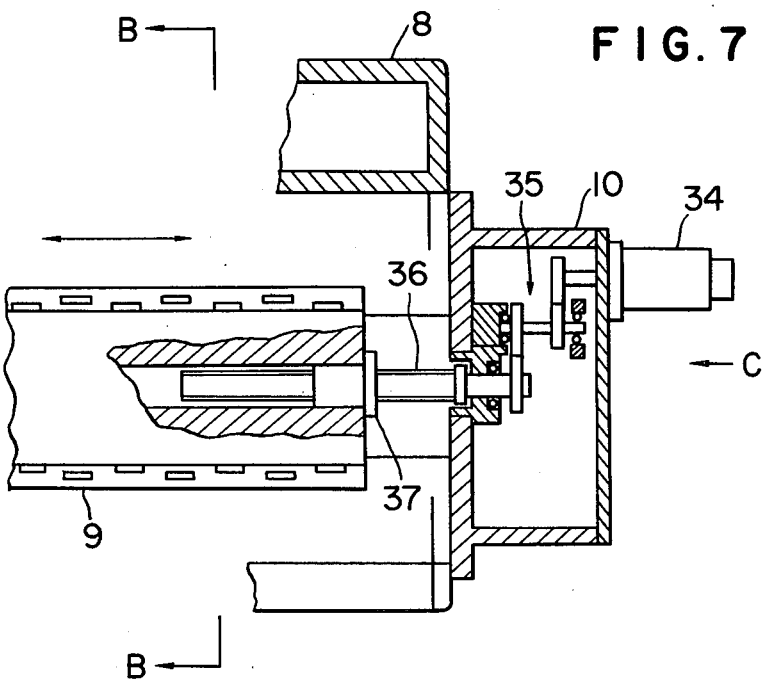
FIG. 7 is a sectional front view of the drive mechanism section of the X-axis slide, said drive mechanism being mounted on the Z-axis slide.
Figure 8:
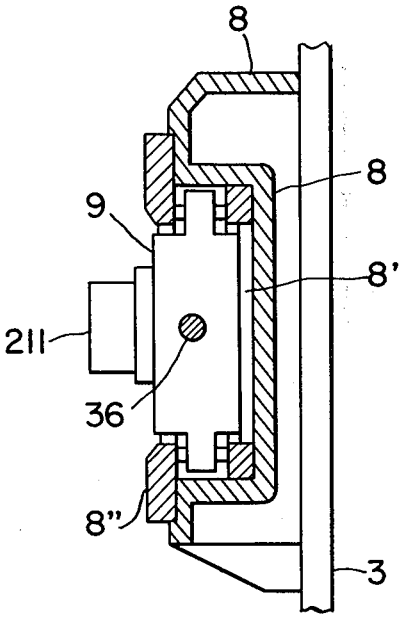
FIG. 8 is a sectional view taken along the line B—B in FIG. 7.
Figure 9:
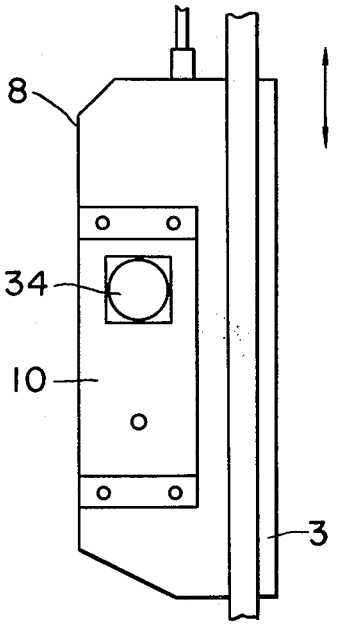
FIG. 9 is a view taken along the arrow C in FIG. 7.
Figure 10:
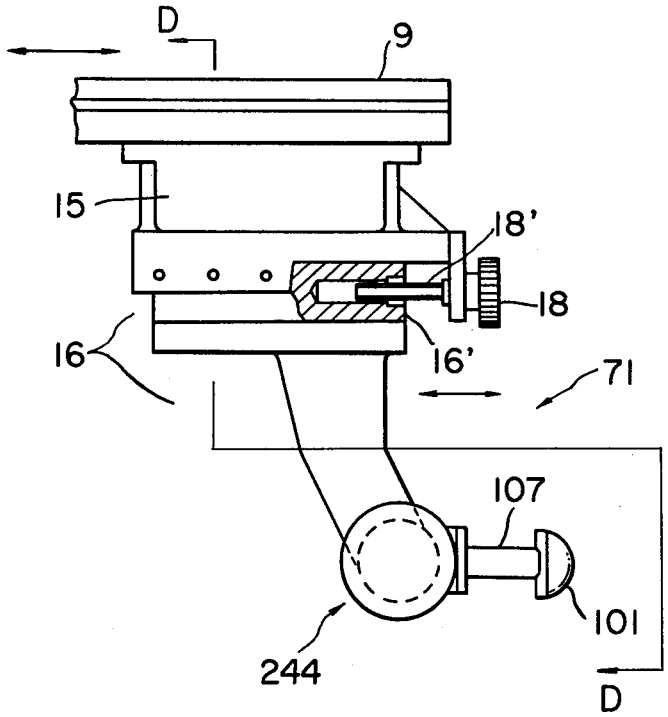
FIG. 10 is a plan view of the copy detecting device.

Referring now to FIGS. 1, 7, and 8, the mounting and driving mechanism of the X-axis slide 9 is to be described in detail. In the Z-axis slide 8, there is provided a horizontally extending guide groove 8', in which the X-axis slide 9 is slidably mounted, with the upper and lower retaining plates 8'' keeping the slide 9 from falling forward out of the groove 8'. There is the drive motor 34 mounted outside the gearbox 10 which is mounted on the Z-axis slide 8, and the drive shaft of said motor 34 drives the ball screw 36 through the gear train 35. This ball screw 36 passes inside the X-axis slide 9 and is in engagement with the nut 37 fixed to said X-axis slide. Therefore, when the motor 34 is driven by control signals generated by the control unit (described later), the ball screw 36 is driven to rotate, and consequently the X-axis slide 9 is moved in the horizontal directions.

Referring next to FIGS. 10 through 17, the duplex electronic copying sensor 71 mounted on the X-axis slide 9 is to be described in detail. On the front face of the X-axis slide 9, there is fixedly mounted the X-axis depth of cut adjusting base 15, which has the guide way 15' at the forward face for slidably mounting the slide 16, which carries the tracer head 244 at the end. At one end of the X-axis depth of cut adjusting base 15, there is provided the depth of cut adjusting knob 18 having the depth of cut adjusting screw 18' which is screwed in the nut 16' fixed to the end of the slide 16, so that when the depth of cut adjusting knob 18 is turned, the slide 16 carrying the stylus 101 is displaced relative to the X-axis slide 9, on which the contact wheel 213 is mounted. The result is that the distance between the contact wheel 213 and the stylus 101 is changed, while the distance between the two fixture tables 27 and 28 is not changed, so that the grinding head 72 is fed towards (or away from) the workpiece W.

In said tracer head 244 attached at the end of the slide 16, there is inserted the tracer rod 243, and there are incorporated the differential transformers DTX and DTY (see FIG. 23) for detecting the X and Y components of the displacement of the tracer rod 243, thereby the differential transformers DTX and DTY generate electric signals to be supplied to the control unit 70 in accordance with the vector displacements of the tracer rod 243 resulting from tracing the surface of the copying model M. At the lower end of the tracer rod 243, there is fastened the base end of the arm 17, which carries the angular displacement detector 113, at the end of which the stylus 101 is mounted, as shown in detail in FIGS. 13 through 17. Referring to these drawings, the stylus 101 has a semicylindrical surface, and is swivelably mounted at the end of the arm 107 by means of the back plate 102 and the pivot pin 103, which is inserted through the bearings 105. The back plate 102 has a beveled surface 128 at the back, with which the end of the spring loaded pin 126 is in contact. This pin, under the force of the spring 124, the force of which is adjustable with the adjusting screw 127, is guided in the case 125 which is incorporated within the arm 107 at an angle of approximately 45°. Although this stylus 101 tends to swivel around the pin 103 clockwise in the representation of FIG. 14 under its own weight, this tendency is nearly counterbalanced by the counterweights 121 attached at the end of the two steel lines 120 fastened to the end of the stylus 101 and extending in parallel in the horizontal backward direction, exerting force tending to swivel the stylus 101 in the counterclockwise direction as viewed in the representation of FIG. 14, and the remaining slight tendency for the stylus to swivel clockwise is countered by the force of the spring 124 working through the pin 126 on the stylus 101, so that normally, the stylus 101 is held with its semicylindrical surface in the vertical position.

The above mentioned arm 107 (carrying the stylus) is flange-mounted on the arm 17 (fastened to the lower end of the tracer rod 243), with the shoulder being machined in the form of the flanges serving as a locator, and is secured by the screws 107'. The angular displacement detector 113 built integral with the arm 107 carries the case 116 in which the differential transformer 114 is installed by means of the fixtures 117, 118, and 119.

Extending through the arm 107 and the angular displacement detector 113, there is the core rod 108 that moves within the differential transformer 114. This core rod 108 is slidably supported by the bearing 109 and the rear bearing 118 that also serves as the fixture, and at the forward end of the core rod, there is connected the swivel arm 110. The swivel arm 110 carries a small anti-friction bearing 111 through which the bearing shaft 112 is inserted, and furthermore, because the hook piece 115 projecting from the back plate 102 holds the bearing shaft 112, when the stylus swivels around the pin 103, the bearing 111 and its shaft 112 is displaced longitudinally, maintaining engagement with the back plate 102 and the hook piece 115, with the result that the swivel motion of the stylus 101 is converted into linear motion of the core rod 108 by means of the swivel arm 110.

The net result of all these movements is that when the stylus 101 comes into contact with the copying model M at slight contact force, in the first place, the tracer rod 243 resiliently supported by the tracer head 244 is displaced under the resulting moment, so that the differential transformers DTX and DTY (making up a two-dimensional detector) generate, in a conventional manner electric signals corresponding to the vector deviations in the X and Y directions, to be utilized to control, in a conventional manner, via the control unit 70, the revolution of the fixture tables 27 and 28, and the horizontal movement of the X-axis slide 9. In the second place, as the stylus 101 is swivelled together with the back plate 102 supporting it around the pin 103, in conformity with the inclination of the surface of the copying model M, the core rod 108 is longitudinally displaced in proportion to the swivel angle of the stylus 101, so that the differential transformer 114 generates voltage signals in proportion to the swivel angle of the stylus 101, the generated voltage signals being sent to the control unit 70 to control the swivel motion of the grinding head 72 in close synchronization with the swivel motion of the stylus 101, with the result that the surface of the workpiece W is ground to the same inclination as that of the surface of the copying model M.

In the duplicating system of this machine, therefore, the grinding head 72 is three-dimensionally controlled, and together with the feed control of the Z axis slide 8 in the Z-axis direction, effected by a speed control and a sequence control, the total duplicating control of the machine is of a continuous four-dimensional mode.

Figure 23:
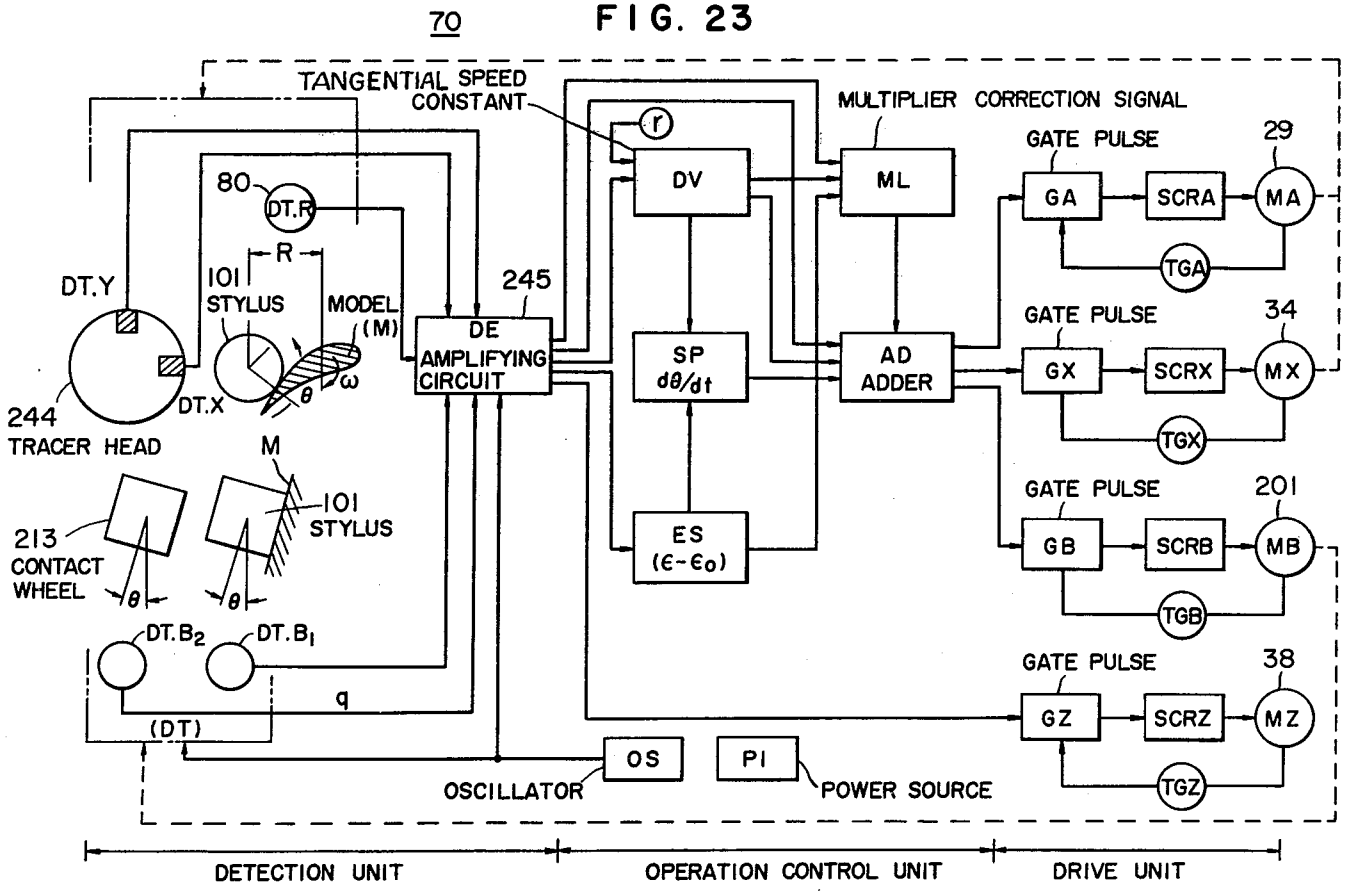
FIG. 23 is a block diagram of the control device.

Furthermore, as shown in FIGS. 1 and 23, on the Z-axis slide 8, there is mounted a differential transformer 80 for registering the distance R between the center of the fixture table 28 and the center of the stylus 101, with its core so disposed as to be relatively displaced as the X-axis slide 9 is displaced. With this arrangement, the differential transformer 80 gives out electric signals in proportion to the distance R, and feed them into the control unit 70, which in turn gives out control signals to the driving motor 29 for the fixture tables 27 and 28 to drive the latters at speeds varying from moment to moment in exact relation to the distance R so that the tangential speed of the grinding head 72 relative to the workpiece W is maintained constant at any point on the workpiece surface.

Figure 20:
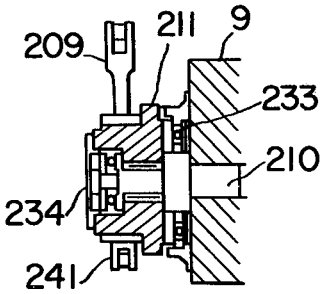
FIG. 20 is a sectional view taken along the line F—F in FIG. 19.
Figure 18:
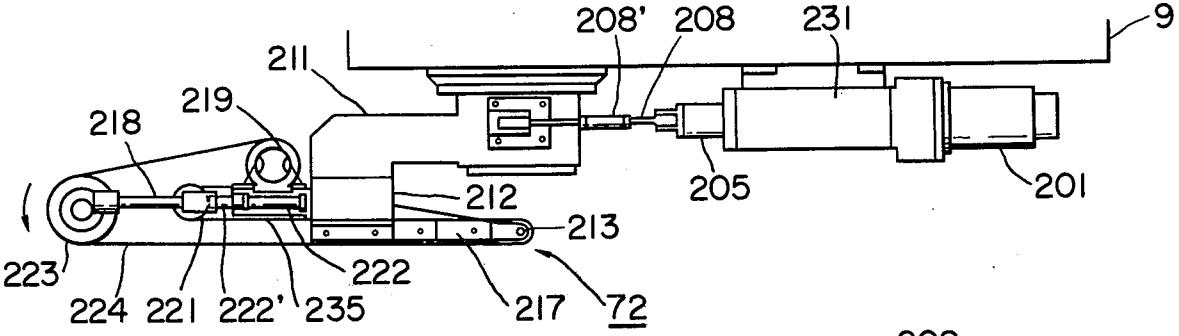
FIG. 18 is a plan view of the swivel mechanism of the grinding belt.

Referring next to the drawings in FIGS. 1, and 18 through 22, the grinding head 72 is to be described in detail. On the X-axis slide 9, there are mounted the motor 201 and the swivel piece 211. This motor 201 is fixedly mounted on the gearbox 202, and drives the ball screw 203 through gears 225 and 226. The ball screw 203 is rotatably supported near the gear end in a bearing 227, and the other end is inserted into the bore of the stroke rod 205 after passing through the nut 204 attached to the inlet end of this stroke rod 205, which is slidingly inserted in the bracket block 231. This stroke rod 205 is slidably supported in the slide bearing 207 which is fastened to the bracket block 231, and its end is connected to one end of the link 208 having a length adjustment means 208'. The other end of this link 208 is connected to the arm 209 of the swivel piece 211. The details of the mounting arrangement of the swivel piece 211 on the X-axis slide 9 is shown in FIG. 20, in which the swivel pin 210 studded firmly in the X-axis slide 9 is seen to swivelably support the swivel piece 211 with the intermediary of the bearing 233, and the nut 234 is seen to prevent the swivel piece 211 from sliding out of the swivel pin 210.

The grinding head base 212 is firmly mounted at the end of the swivel piece 211, and the grinding head base 212 carries the bracket 217 having the contact wheel 213 at the end, and the bracket plate 235 having the bar 218 extending in the direction opposite from the contact wheel 213. The bar 218 carries at the end the pulley 223, the bracket plate 235 have the air cylinder 222 mounted thereon, the end of the piston rod 222' of the air cylinder 222 carries the tension pulley 221, and the bracket plate 235 further carries the hydraulic motor 220 and the drive pulley 219. The grinding belt 224 is applied over all these pulleys, that is, the contact wheel 213, the pulley 223, the tension pulley 221, and the drive pulley 219.

Figure 22:
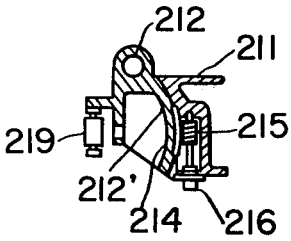
FIG. 22 is a sectional view taken along the line H—H in FIG. 19.
Figure 21:
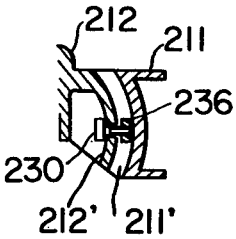
FIG. 21 is a sectional view taken along the line G—G in FIG. 19.

Furthermore, it should be noted in the sectional views of FIGS. 21 and 22, that said grinding head base 212 is mounted on the swivel piece 211 in a manner which allows angular adjustment of the former. That is, as can be seen in FIG. 21, the circular surface 212' of the grinding head base 212 is in close contact with the corresponding circular surface of the swivel piece 211, and the nut 236 inserted within the groove 211' machined in the swivel piece 211 is designed to accept the screw 230 inserted from the inside of the grinding head base 212 for the purpose of clamping the grinding head base 212 onto the swivel piece 211 at a desired angular position along the circular surface 212'. Furthermore, as shown in FIG. 22, the circular surface 212' of the grinding head base 212 is machined into a worm wheel at one portion along a small arc 214, and the worm 215 rotatably mounted on the swivel piece 211 is in mesh with this worm 214, so that when the worm 215 is turned by a removable handle applied on the end 216 of the worm 215, the grinding head base 212, together with all the grinding mechanisms mounted thereon, is angularly adjusted relative to the swivel piece 211.

Figure 11:
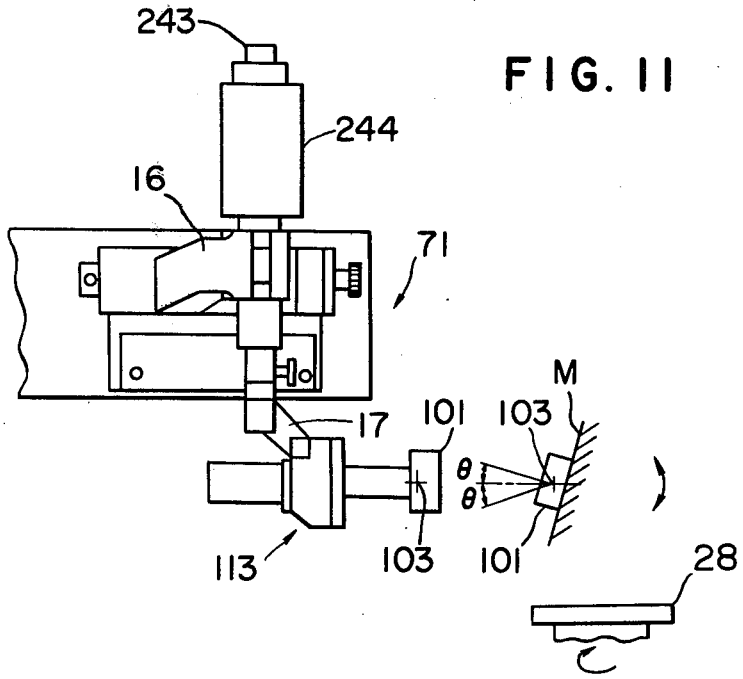
FIG. 11 is an explanatory front view of the above copy detecting device.
Figure 12:
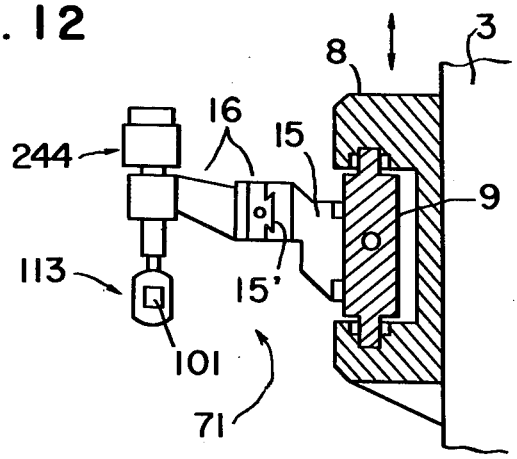
FIG. 12 is a sectional view taken along the line D—D in FIG. 10.
Figure 13:
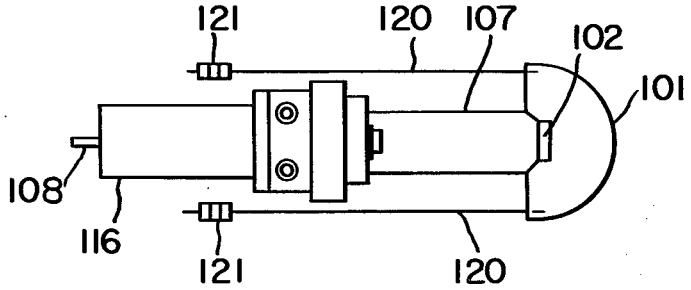
FIG. 13 is a plan view of the copy detecting head.
Figure 14:
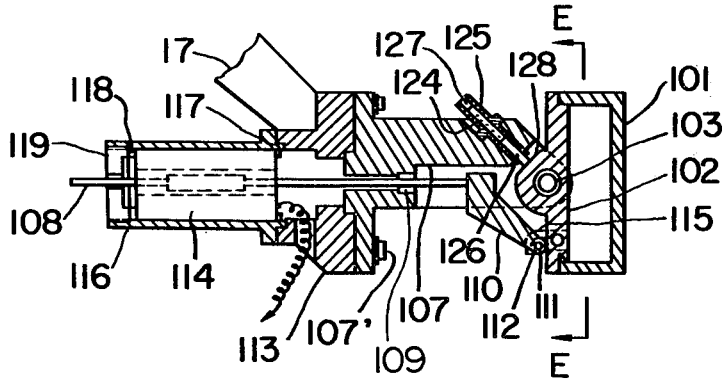
FIG. 14 is a vertical sectional view of the above copy detecting head.
Figure 15:
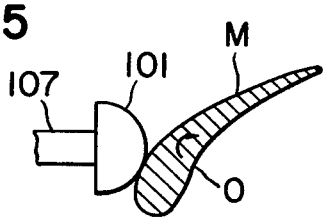
FIG. 15 and FIG. 16 are an explanatory plan view and an explanatory side view showing the contacting condition between the stylus and the copying model.

However, in the normal working mode, the contact wheel 213 is mounted with its axis vertically disposed, and furthermore, because this axis is located so as to intersect the extension of the axis line of the swivel pin 210 for the swivel piece 211, when the swivel piece 211 is made to swivel, the contact wheel 213 carried thereon is made to swivel as if it is pivoted at the point O at the center thereof. In this arrangement, therefore, when the stylus 101 is swivelled around its axis 103, by contacting with the surface of the copying model M in the form of a turbine blade or the like, as shown in FIG. 11, the grinding head 72 is swivelled in exact synchronization with it to reproduce an accurately duplicated three-dimensional surface.

Figure 19:
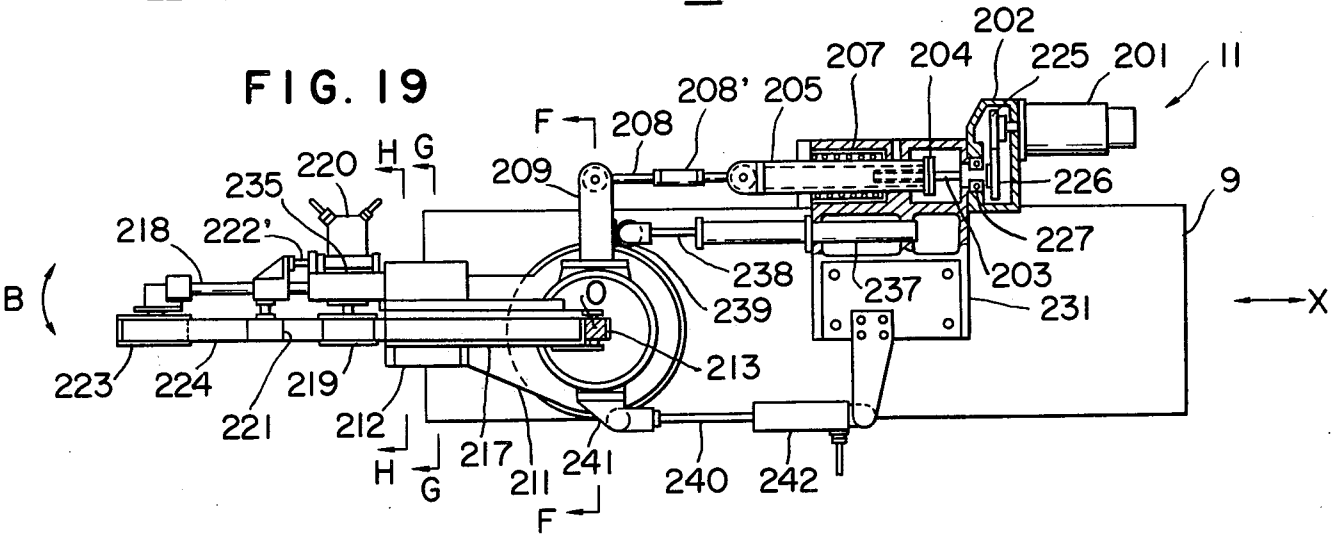
FIG. 19 is a front view of the above swivel mechanism.

Referring now to FIG. 19, the differrential transformer 237 has the core rod 238 inserted therethrough, said core rod 238 carrying at the end the roller 239, which is in contact with the side of the arm 209 of the swivel piece 211, so that any swivel motion of the latter drives the core rod 238 linearlly correspondingly, with the result that the differential transformer 237 produces corresonding electric signals to be sent to the control unit 70 where they are used as feed back signals to confirm the swivel motion of the contact wheel 213. Furthermore, there is disposed the hydraulic balancer 242, of which the end of the push rod 240 is pivoted to the arm 241 projecting from the lower part of the swivel piece 211 to resist any tendency of the latter to deviate from its normal attitude.

In this arrangement of the grinding head, therefore, when a command signal from the control unit 70 drives the motor 201, the swivel piece 211 is swivelled accordingly, so that the contact wheel 213 is swivelled in accurate synchronization with the stylus 101 swivelling around the pivot pin 103 in tracing the surface of the copying model M, and the grinding belt passing over this contact wheel and being driven by the drive pulley 219 is made to grind the surface of the workpiece into the shape of the copying model.

Figure 16:
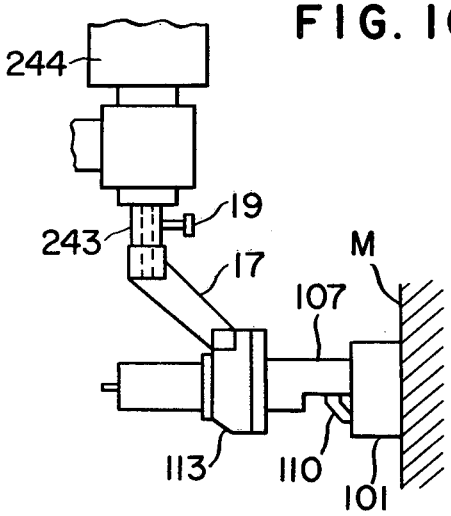
Figure 17:
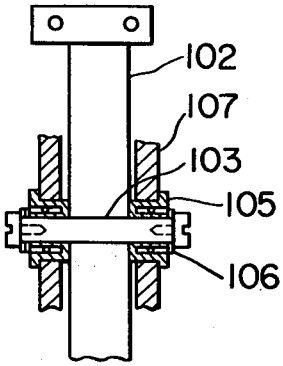
FIG. 17 is a partial sectional view taken along the line E—E in FIG. 14.

Referring now to FIG. 23 representing one example of control unit 70 to be adoptable in the present invention, the entire sequence of operations of the preferred embodiment machine is as follows: Initially, the workpiece W and the copying model M are vertically mounted respectively on the fixture tables 27 and 28 (see FIG. 6), and the Z-axis slide 8 is brought at its lowest position on the column 3. When the start button is pushed, the motor is started, and drives the X-axis slide 9 until the stylus 101 and the grinding head 72 respectively come into contact with the copying model M and the workpiece W. When the stylus 101 comes into contact with the copying model M, as shown in FIGS. 11 and 16, the two-dimensional detector, or the differential transformers DTX and DTY, incorporated in the tracer head 244 of the duplex electronic copying sensor 71 detects the displacement of the stylus and sends corresponding signals to the amplifying circuit 245 of the control unit 70, which sends out corresponding drive command signals to the motors 29 and 34. At the same time, when the stylus 101 is swivelled around the pin 103, the differential transformer 114 of the angular displacement detector 113 sends a corresponding electric signal to the control device 70, which in turn sends out a corresponding command signal to the motor 201 to tilt the swivel piece 211 carrying the grinding head 72 accordingly. As the result of these three separate control operations, the entire surface of the copying model M, including tilted surface portions, is accurately duplicated on the workpiece W. The controlled swivel motion of the swivel piece 211 determining the angular attitude of the grinding head which grinds the surface of the workpiece W is monitored by the differential transformer 237, and its monitor signal is fed back to the control unit 70 so that any erroneous swivelling motion of the grinding head 72 is immediately corrected.

Simultaneous with these operations, the Z-axis slide 8 is also driven upward by the motor 38 which is designed to be sequentially controlled.

From the foregoing descriptions, it is clear that not only the present invention provides a simple copying system capable of reliably performing four control motions, the vertical motion of the Z-axis slide, the horizontal motion of the X-axis slide, the turning motion of the fixture tables, and the swivel motion of the grinding head in synchronization with the stylus, but also it provides an automatic copying belt grinding machine capable of reliably controlling these four motions simultaneously with a simple control device. Furthermore, with the present invention, because the tangential grinding speed to the surface of the workpiece is always maintained at a constant value, grinding accuracy and working efficiency are substantially improved.

Whereas the present invention has been shown and described herein in what is conceived to be the best made contemplated it is recognized that departures may be made therefrom within the scope of the invention which is, therefore, not to be limited to the details disclosed herein, but is to be afforded the full scope of the invention as hereinafter claimed.

What is claimed is:

1. An automatic copying belt grinding machine, comprising a Z-axis slide movable in a vertical direction, an X-axis slide slidably mounted on said Z-axis slide to shift horizontally, a swivelling grinding head mechanism mounted on said X-axis slide, a duplex electronic copying sensor having a portion for sensing the contour of a model and a swivelling portion for sensing the inclination of a surface of said model mounted on said X-axis slide, a pair of fixture tables rotatable in synchronization with each other upon which a model related to the duplex electronic copying sensor and a workpiece related to said swivelling grinding head mechanism are respectively vertically installed, and an electronic control unit for controlling said Z-axis slide and said X-axis slide and said copying sensor and said grinding head so that they function in a copying mode, whereby the grinding machine copy grinds the workpiece continuously and spirally along the peripheral direction over its entire length, while the tangential speed of the grinding head relative to the workpiece is kept constant and the grinding head is positioned normal to the surface of the workpiece at the point of contact.

* * * * *